US005512715A

United States Patent [19]

Takewa et al.

[11] Patent Number: 5,512,715

[45] Date of Patent: Apr. 30, 1996

[54] SOUND ABSORBER

[75] Inventors: Hiroyuki Takewa, Kaizuka; Yutaka Torii, Kadoma, both of Japan

[73] Assignee: Matsushita Electric Industrial Co., Ltd., Osaka, Japan

[21] Appl. No.: 260,232

[22] Filed: Jun. 14, 1994

[30] Foreign Application Priority Data

Jun. 15, 1993 [JP] Japan ..... 5-142481

[51] Int. Cl.[6] ..... E04B 1/82

[52] U.S. Cl. ..... 181/295; 181/286; 181/290; 52/144; 52/145

[58] Field of Search ..... 181/30, 286, 287, 181/290, 291, 292, 293, 295; 52/144, 145

[56] References Cited

U.S. PATENT DOCUMENTS

| | | | |
|---|---|---|---|
| 2,923,372 | 2/1960 | Maccaferri | 181/30 |
| 3,819,007 | 6/1974 | Wirt et al. | 181/290 |
| 4,106,587 | 8/1978 | Nash et al. | 181/290 X |
| 4,170,674 | 10/1979 | Matsuki | 181/293 X |
| 4,607,466 | 8/1986 | Allred | 181/293 X |
| 5,004,070 | 4/1991 | Wang | 181/286 |

*Primary Examiner*—Khanh Dang
*Attorney, Agent, or Firm*—Wenderoth, Lind & Ponack

[57] ABSTRACT

A sound absorber arrangement includes a plurality of sound absorbing layers of porous materials such as glass wool, rock fiber or cellular plastic, and high-polymer films, are alternately laminated in a direction perpendicular to a sound incidence plane. The layer thicknesses are increased in order in a direction away from the sound incidence plane. The sound absorber arrangement makes it possible to make a sound absorbing coefficient constant over the low to high frequency sound range.

6 Claims, 9 Drawing Sheets

P: INCIDENCE PLANE OF SOUND

SOUND ABSORBER

BACKGROUND OF THE INVENTION

1. Field of the Invention

This invention relates to an audio system which uses a plurality of analogical acoustical assemblies in combination to thereby provide a sound space capable of obtaining good sound reverberation with an average sound absorbing coefficient of 0.1 to 0.5.

2. Description of the Prior Art

Recently, acoustical assemblies used for sound absorption, reflection and sound-shields have been, as shown in FIG. 9, suitably arranged in a room to realize a sound space with an average sound absorbing coefficient of 0.1 to 0.5, and this is becoming the standard in audio related industries.

Under such a circumstance, an audio system having a speaker system for reproducing sound, a sound absorption system for absorbing sound, a reflection system for reflecting and diffusing sound and a sound shield system for shielding sound provided on the same cabinet has been disclosed in Japanese Laid-Open Patent Application No. 2-201498.

A listening room or the like to be used for an audio application employs a sound absorption material in order to control sound reverberation. As the sound absorption material to be used for this purpose, an absorbing layer made of porous material such as glass wool, rock fiber, cellular plastic or the like is known, which will be explained by referring to the drawings.

Conventionally, a surface of a wall is formed by arranging the sound absorption material 91 and a reflection cabinet 94 in the same or analogical shape on a surface of a front surface baffle of a reflection cabinet 92 as shown in FIG. 9. The reflection cabinet 94 has a projection 93 having a quadrangular pyramidal form to reflect sound in a direction of a projection surface. By forming a space by the surface of the wall, a sound reproducing space such as that shown in FIG. 9 is realized.

However, the sound absorption material 91 shown in FIG. 10 has a limitation in the frequency of sound to be absorbed, due to a material characteristic which is determined depending on a thickness of the absorbing layer made of porous material such as glass wool, rock fiber or cellular plastic. On the other hand, a thickness of the wall is about 8 to 15 cm, for example, in the case of a partition. In such case, a thickness of the sound absorption material ranges from 5 to 10 cm. As shown in FIG. 11, frequency response of sound to be absorbed of the absorbing layer made of porous material is such that when the frequency is low, a sound absorbing coefficient is small and when the frequency is high, the sound absorbing coefficient is large. As a result, in order to realize the desired sound adsorptive condition, the sound absorbing coefficient of the surface of the wall may be made large. Accordingly, if the thickness of the sound absorption material is made large, the sound absorbing coefficient of a low frequency sound becomes large and at the same time, the sound absorbing coefficient of a high frequency sound also becomes large. In addition, even when an area of the sound absorption material 91 shown in FIG. 12 is increased to make a sound absorption area large, a sound absorption characteristic of such a room becomes high in the high frequency range as shown in FIG. 13 due to the fact that the high frequency sound and the low frequency sound are different in equivalent absorption area from each other.

Also, a multilayered sound absorption material is known which is formed of plural sound absorption materials providing air layers therebetween. It becomes thick structurally because of the provision of the air layers therebetween, so that thickness of the sound absorption material ranging from 5 to 10 cm cannot be realized. The thickness of the sound. absorption material is only increased specifically, so that the sound absorbing coefficient for the low frequency sound becomes large and at the same time, the sound absorbing coefficient for the high frequency sound also becomes large. As a result, the sound absorbing coefficient for the high frequency sound becomes higher, thus making it difficult to realize a sound absorber having a constant sound absorbing coefficient. Accordingly, the reverberation time of the room becomes long for the low frequency sound and short for the high frequency sound. Consequently, the low frequency sound is not absorbed and diffused, so that a desired reverberation characteristic cannot be obtained, or standing waves and/or echo problems cannot be removed.

Also, a sound shield panel which absorbs the high frequency sound, and reflects and transmits the low frequency sound is disclosed in U.S. Pat. No. 3,628,626. An object of this panel is that the high frequency sound is absorbed as much as possible and the low frequency sound is reflected by an inner layer metal plate to thereby prevent the sound from being leaked outside from a partition. As a result, acoustic characteristics of an inside space divided by the partition cannot be controlled for all frequencies of the sound range.

SUMMARY OF THE INVENTION

An object of this invention is to provide a sound absorber superior in that a sound absorbing coefficient is constant over a low to high frequency sound range. Another object of this invention is to provide a sound absorber which has a constant sound absorbing coefficient over the low to high frequency sound range and a diffusion effect. With the sound absorber described above, a constant reverberation characteristic can be realized over the high to low frequency sound range and standing waves or echo problems can be removed to thereby realize a superior acoustic effect.

In order to attain the above-mentioned objects, a first sound absorber of this invention has a laminated structure having absorbing layers made of porous materials and high-polymer films being alternately laminated as a plurality of sets and has an incidence plane of sound at one surface of the laminated structure. The absorbing layer made of porous materials and the high-polymer films are laminated in parallel to the incidence plane of sound and have respective thicknesses increased in the order from a side of the incidence plane of sound.

In order to attain the above-mentioned objects, a second sound absorber of this invention has a laminated structure in which high-polymer films and absorbing layers made of porous materials are alternately laminated as a plurality of sets and has an incidence plane of sound at one surface of the laminated structure. The absorbing layers made of porous materials and the high-polymer films are laminated in parallel to the incidence plane of sound, and the absorbing layers made of porous materials are different in thickness from each other and their surfaces are respectively partially covered with the high-polymer films, which respective have thicknesses which increase in the order from a side of the incidence plane of sound. The surfaces partially covered respectively with the high-polymer films increase in area in the order from the side of the incidence plane of sound.

In order to attain the above-mentioned objects, a third sound absorber of this invention has an incidence plane of sound at one surface of the sound absorber, and comprises a rectangular parallelepiped-shaped cabinet having a front surface baffle. The front surface baffle has an aspect ratio of 1:N, where N is a positive integer. A porous material sound absorption system is fixed on the front surface baffle in parallel to the incidence plane of sound. A plurality of perforated holes are provided in the porous material sound absorption systems and pass from the incidence plane of sound through the front surface baffle of the rectangular parallelepiped-shaped cabinet. Cylindrical pipes having outer diameters substantially equal to diameters of the perforated holes, and lengths different from lengths of the perforated holes, are inserted in the holes.

In order to attain the above-mentioned objects, a fourth sound absorber of this invention, which has an incidence plane of sound at one surface of the sound absorber, comprises a rectangular parallelepiped-shaped cabinet having a front surface baffle, the front surface baffle having an aspect ratio of 1:N, where N is a positive integer. A plurality of partitions are provided in parallel to a side surface of the rectangular parallelepiped-shaped cabinet. A plurality of porous material sound absorption systems are fixed on the front surface baffle divided by the plurality of partitions horizontally to the incidence plane of sound. A plurality of perforated holes are provided in the front surface baffle, and cylindrical pipes having outer diameters substantially equal to diameters of the perforated holes and lengths different from lengths of the perforated holes are inserted in the holes.

As described above, according to this invention, sound absorbers that have a constant sound absorbing coefficient over the low to high frequency sound range are provided. If the sound absorbers are arranged in a room, a uniform reverberation characteristic can be obtained over the low to high frequency sound range. Consequently, audio systems without standing waves and echo problems, and with superior acoustic effects, can be realized.

DETAILED DESCRIPTION OF THE INVENTION

Figure 1:
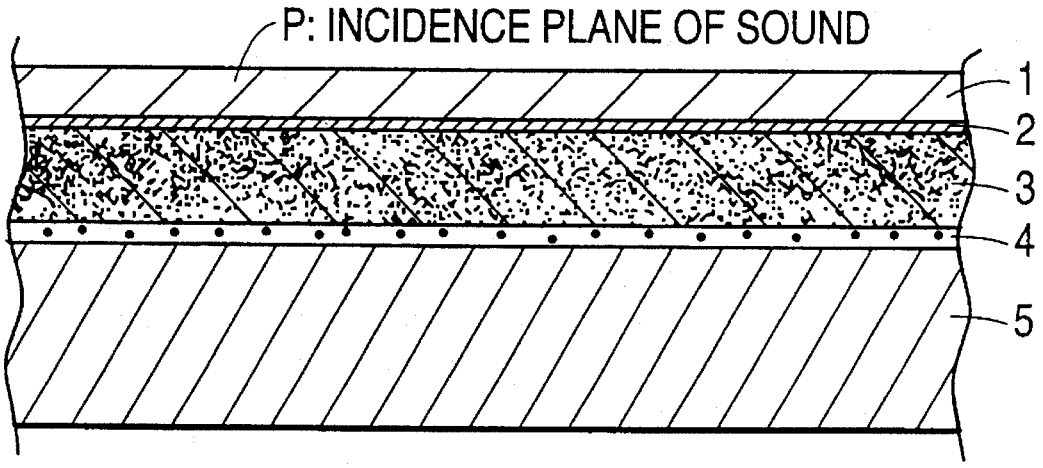
FIG. 1 is a cross-sectional view of a sound absorber according to a first embodiment of this invention.
Figure 14:
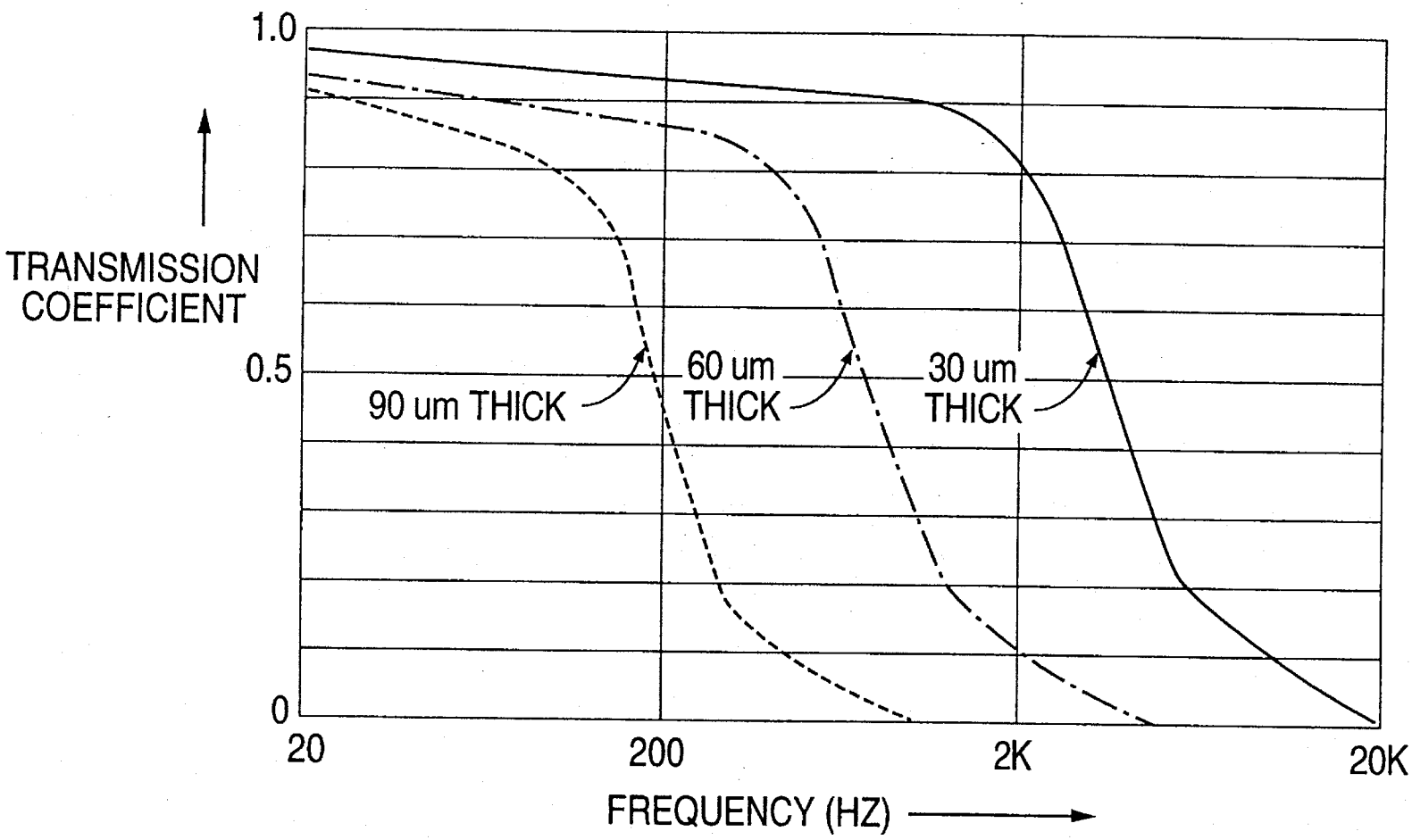
FIG. 14 is a characteristic diagram showing a relation of a transmission coefficient and a frequency when a thickness of a high-polymer film is varied.

A sound absorber according to a first embodiment of this invention will be described below while referring to the drawings. As shown in FIG. 1, the sound absorber of the first embodiment has an absorbing layer 1 made of porous material which is made of glass wool, rock fiber or cellular plastic and whose upper surface is an incidence plane P of sound, a high-polymer film 2 such as polyethylene, polyarylate or the like adhered onto a lower surface of the absorbing layer i made of porous material, an absorbing layer 3 made of porous material which is made of glass wool, rock fiber or cellular plastic and whose upper surface is adhered onto a lower surface of the high-polymer film 2, and a high-polymer film 4 whose thickness is larger than that of the high-polymer film 2 and whose upper surface is adhered onto a lower surface of the absorbing layer 3 made of porous material. The absorbing layer i made of porous material has a thickness so as to provide a constant sound absorbing coefficient at a high frequency. The high-polymer film 2 has a thickness so as to reflect any sound having a frequency higher than that of the sound that the absorbing layer 1 made of porous material can absorb and so as to transmit any sound having a frequency lower than that of the sound that it can absorb. The high-polymer film 2 changes frequency of the sound to be transmitted with a change in film thickness as shown in FIG. 14, which shows that a thick film can transmit only a low frequency sound. As a result, when the sound is incident to the high-polymer film 2, a high frequency sound is reflected, and the low frequency sound and a intermediate frequency sound are transmitted. Accordingly, by increasing a thickness of each of the high-polymer film in order from a side of the incidence plane of sound, the sound having a lower frequency can be selectively transmitted to a deeper layer. The absorbing layer 3 made of porous material is larger in thickness than the absorbing layer 1 made of porous material to absorb the intermediate frequency sound constantly. Besides, in order to provide a desired sound absorbing coefficient, a thickness of the absorbing layer 3 made of porous material is determined by taking a transmission coefficient of the intermediate frequency sound that transmits the high-polymer film 2 and a sound absorbing coefficient of the intermediate frequency sound that is absorbed by the absorbing layer 1 made of porous material in consideration. For example, if the sound absorbing coefficients of the high frequency sound and the intermediate frequency sound of the absorbing layer 1 made of porous material are 0.7 and 0.1, respectively, and the transmission coefficient of the intermediate frequency sound of the high-polymer film is 0.9, the thickness of the absorbing layer 3 made of porous material is made so as to provide the sound absorbing coefficient of 0.66 for the intermediate frequency sound. (In this case, the sound absorbing coefficient is the sound absorbing coefficient when provided with a film on one side thereof.) As a result, the intermediate frequency sound is absorbed by 10% by the absorbing layer 1 made of porous material and 60% by the absorbing layer 3 made of porous material, resulting in the absorption of 70% in total. Similarly, the high-polymer film 4 provided next to the absorbing layer 3 made of porous material has a thickness larger than the high-polymer film 2 and yet, transmits any sound having a frequency lower than that of the sound that the absorbing layer 3 made of porous material can absorb. An absorbing layer 5 made of porous material is adhered to a lower surface of the high-polymer film 4, a thickness of the absorbing layer 5 made of porous material is larger than that of the absorbing layer 3 made of porous material and made so as to absorb the low frequency sound constantly. The thickness thereof is determined by taking the transmission coefficient of the low frequency sound that transmits the high-polymer film 4 and the sound absorbing coefficients of the low frequency sound that is absorbed by the absorbing layers 1 and 3 made of porous materials into consideration.

Figure 11:
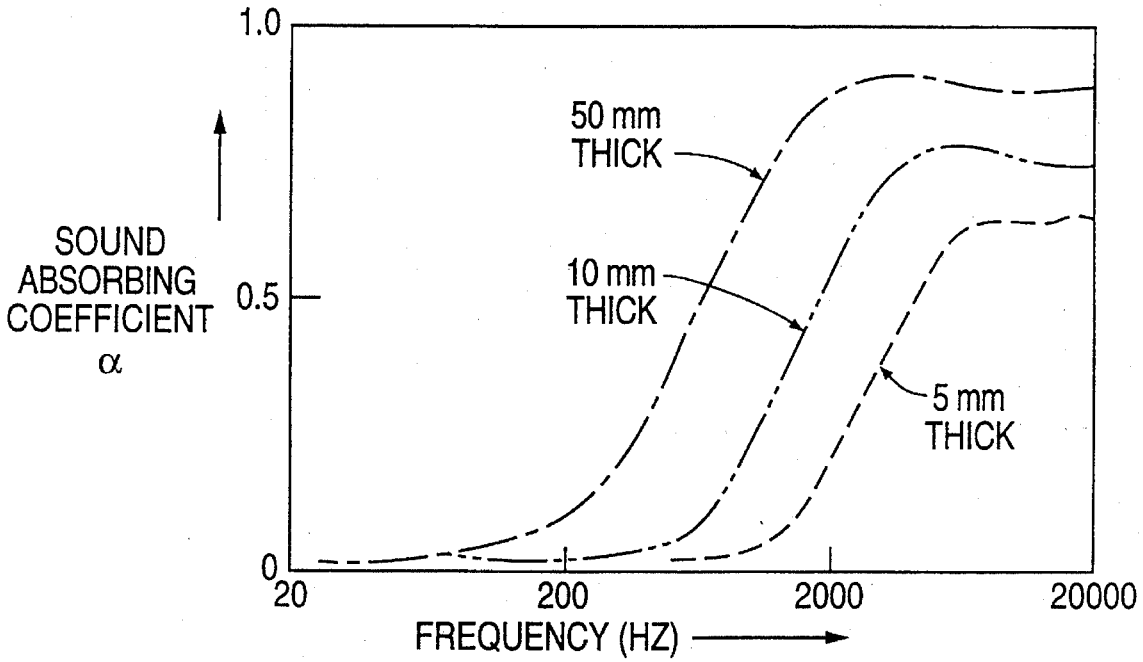
FIG. 11 is a diagram showing a relations absorbing coefficient and a frequency when a thickness of a porous material of a sound absorber is varied.
Figure 12:
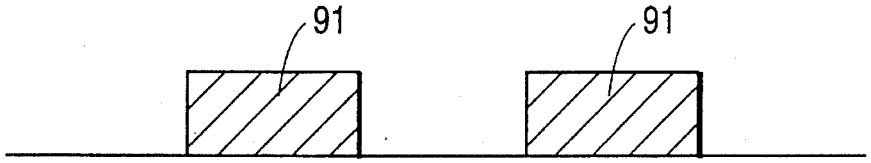
FIG. 12 PRIOR ART
FIG. 12 is a cross-sectional view of a conventional absorbing layer made of porous material whose area is varied.
Figure 13:
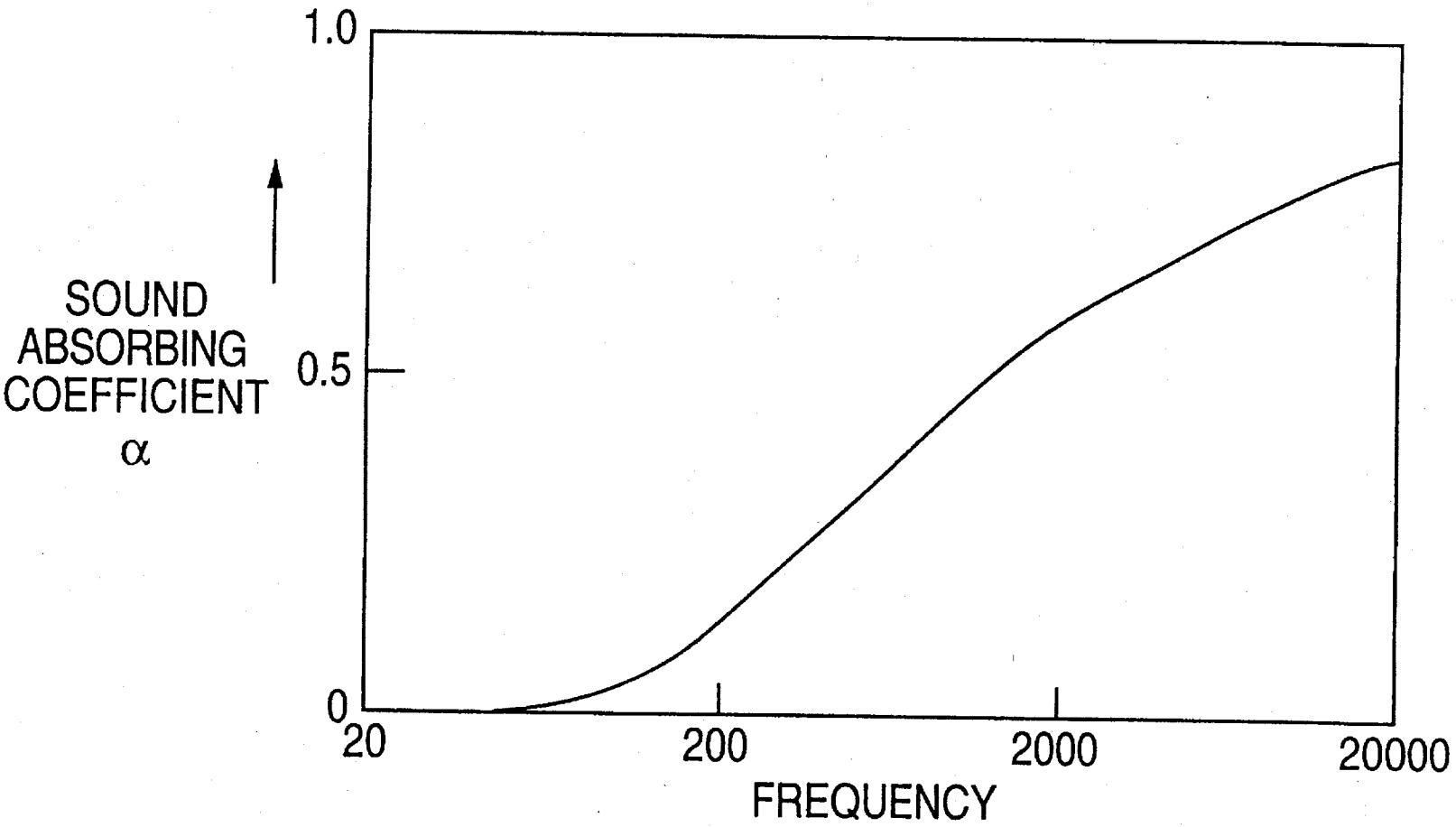
FIG. 13 is a diagram showing the relation of the sound absorbing coefficient and the frequency of a room whose surface of the wall is formed of absorbing layers having varied areas.

For example, an explanation will be provided for a case in which an absorbing layer made of porous material having the sound absorbing coefficient of 0.7 is made by using the absorbing layer made of porous material of which a relation of the sound absorbing coefficient and the thickness is shown in FIG. 11 and the high-polymer film of which a relation of the transmission coefficient and the thickness is shown in FIG. 14. FIG. 14 shows the relation of the frequency and the transmission coefficient when the thickness of the high-polymer film (made of Teflon, polyethylene, polyarylate or the like) is varied. This shows that if the transmission coefficient is 0.9, 90% of energy of the sound is transmitted from a surface (the incidence plane of sound) to a side of an opposite surface thereof. First, realization of the sound absorption characteristic for the high frequency sound will be considered. From FIG. 11, it can be found that the absorbing layer made of porous material of 5 mm thickness has the sound absorbing coefficient of 0.7 at the frequency of 5000 Hz or above. It can be found from FIG. 14 that if a film of 30 μm thick is used as the high-polymer film 2 to be adhered to the absorbing layer made of porous material, about 90% of the sound having the frequency of 5000 Hz or below is transmitted and the sound having the frequency of 5000 Hz or above is reflected. For the sound absorption characteristic for the intermediate frequency sound, consideration will be given to the above-mentioned relation between transmission and absorption of sound. The sound absorbing coefficient of the intermediate frequency sound may be 0.66. The thickness of the absorbing layer made of porous material having such sound absorbing coefficient is selected from FIG. 11 it can be found from FIG. 11 that the absorbing layer made of porous material of 10 mm thick is preferable in that the sound absorbing coefficient ranges from 0.5 to 0.8 in the sound frequency range of 1500 to 4000 Hz. As a result, an absorbing layer made of porous material and having a thickness of 10 mm may be employed as the absorbing layer 3 made of porous material for use with intermediate frequency sound. Similar to the above case, it can be found from FIG. 14 that if the thickness of the high-polymer film is 60 μm, the sound having the frequency exceeding 1500 Hz is reflected and about 90% of the sound having the frequency not exceeding 1500 Hz is transmitted to the high-polymer film 4. In addition, for the sound passing through the high-polymer film 4 and having the frequency range of 1500 Hz or below, the absorbing layer made of porous material having the thickness of 50 mm is similarly preferable in that the sound absorbing coefficient over the sound frequency range of 500 to 1500 Hz ranges from 0.5 to 0.8. As a result, if three absorbing layers made of porous materials respectively having thicknesses of 5 mm, 10 mm and 50 mm are laminated in order from the incidence plane of sound, a porous material sound absorption system having the sound absorbing coefficient 0.7 over the sound frequency range of 500 Hz to 10 KHz can be realized.

The operation of the sound absorber structured as above will be explained below. In the sound absorber of the first embodiment, the high frequency sound is absorbed by the absorbing layer 1 made of porous material. Since the high-polymer film 2 is adhered to the absorbing layer 1 made of porous material, the high frequency sound is reflected so that it does not go to deeper layers, but the intermediate frequency sound passes through the high-polymer film 2. The intermediate frequency sound is absorbed by the absorbing layer 3 made of porous material provided under the high-polymer film 2. And yet, the absorbing layer 3 made of porous material is larger in thickness than the absorbing layer 1 made of porous material and formed such that the intermediate frequency sound has the same sound absorption power as that of the high frequency sound in the absorbing layer 3 made of porous material. Accordingly, the high and intermediate frequency sounds are substantially identical in sound absorption power to each other. Furthermore, the low frequency sound is similarly passed through the high-polymer film 4 provided under the absorbing layer 3 made of porous material and absorbed by the absorbing layer 5 made of porous material provided under the high-polymer film 4. As explained above, the high-polymer films selectively propagate the sound to the deeper layers, so that sound absorption can be selectively achieved by respective absorbing layers made of porous materials. In addition, the thicknesses of the absorbing layers made of porous materials and the thicknesses of the high-polymer films are respectively determined so as to make the sound absorption powers of the absorbing layers made of porous materials equal to each other. Accordingly, the sound absorber of this first embodiment has a constant sound absorbing coefficient over the low to high sound frequency range.

Figure 2:
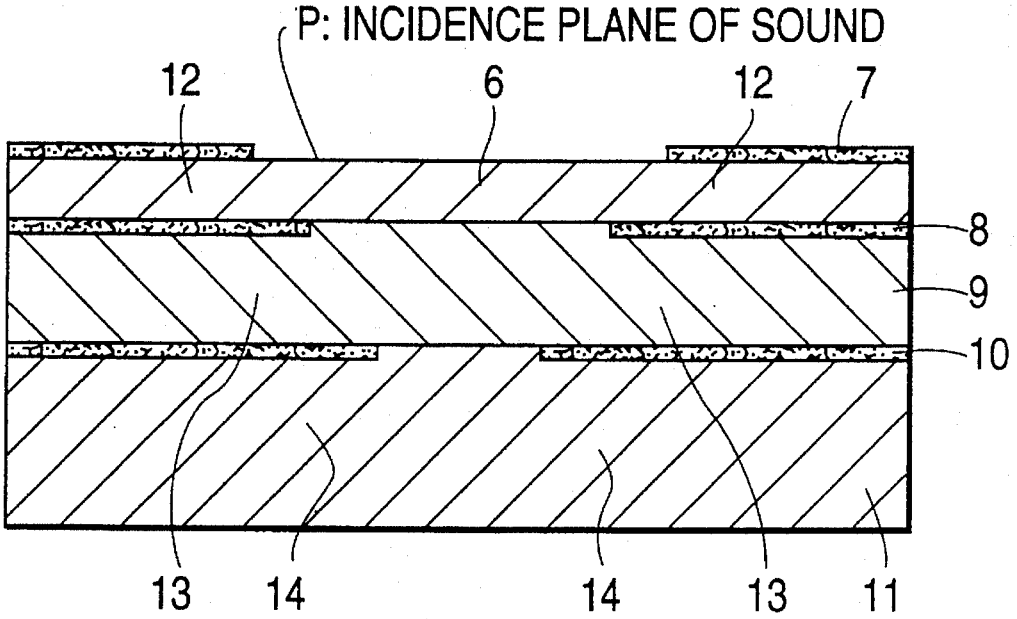
FIG. 2 is a cross-sectional view of the sound absorber according to a second embodiment of this invention.

Next, a sound absorber according to a second embodiment of this invention will be described while referring to the drawings. In the second embodiment as shown in FIG. 2, a part of a surface of an absorbing layer 6 made of porous material glass wool, rock fiber or cellular plastic on a side of an incidence plane P of sound is covered with a high-polymer film 7 so as to substantially prevent transmission of low frequency sound. For example, according to FIG. 14, if the high-polymer film having a thickness of 90 μm or above is used, more than 90% of the sound having a frequency of 300 Hz or above is reflected. An absorbing layer 9 made of porous material which is also partially covered with a high-polymer film 8 is adhered to a surface of the absorbing layer 6 on a side thereof opposite the side of the incidence plane P. An absorbing layer 11 made of porous material partially covered with a high-polymer film 10 is similarly adhered to the surface of the absorbing layer 9 on a side thereof opposite the side of the incidence plane P. Absorbing layers 6, 9 and 11 made of porous materials partially covered respectively with high-polymer films 7, and 10 are increased in thickness in the order from the side of the incidence plane of sound. Respective thicknesses of the absorbing layers made of porous materials are designed such that substantially the same sound absorbing coefficients can be provided in respective ranges of high, intermediate and low sound frequencies. In addition, areas of respective apertures of absorbing layers made of porous materials are decreased in order at aspect ratios described latter.

An operation of the sound absorber structured as above will be explained below. If the sound is incident to the incidence plane P of sound, the high frequency sound is absorbed by the absorbing layer 6 made of porous material which is a thin layer. Since the high-polymer film 7 is provided under the absorbing layer 6 made of porous material, the sound absorption power of the high frequency sound to be absorbed may be expressed in terms of a value obtained by multiplying the sound absorption power of the absorbing layer 6 made of porous material by an aspect ratio determined by a ratio of a surface area of the absorbing layer 6 made of porous material and a surface area of the high-polymer film 7. The absorbing layer 6 made of porous material is laminated directly to the absorbing layer 6 made of porous material. A part of the absorbing layer 9 made of porous material directly laminated to the absorbing layer 6 made of porous material acts as an absorbing layer thicker than the absorbing layer 6 made of porous material. The intermediate and low frequency sounds are partially absorbed by the absorbing layer made of porous material and at the same time, transmitted to the absorbing layer 9 made of porous material and a side part 12 of the absorbing layer 6 made of porous material, and absorbed. In this case, the side part 12 acts as an equivalently thicker absorbing layer made of porous material when looking from the direction perpendicular to a incident direction of the sound. As a result, the side part 12 also absorbs the intermediate and low frequency sounds. A sound absorption area of the intermediate frequency sound corresponds to a sum of an area of the side part 12 and an aperture area of the high-polymer film 8 provided therebeneath. If the sound absorption area of the intermediate frequency sound is formed to be equal to an aperture area of a surface where the high frequency sound is absorbed, the sound absorbing coefficients of the high and intermediate frequency sounds become equal to each other. In addition, the low-frequency sound is similarly absorbed by a thicker sound absorption layer comprising the absorbing layers 6, 9 and 11 made of porous materials and respective side parts 12, 13 and 14 of the absorbing layers 6, 9 and 11 made of porous materials. The sound absorption area of the low frequency sound consists of the side parts 12, 13 and 14 and an aperture area of the high-polymer film 10 provided therebeneath. The aperture area of the high-polymer film 10 is formed to be equal to the aperture area of the surface where the high frequency sound is absorbed. Accordingly, the sound absorption powers of the intermediate and low frequency sounds can be made equal to each other.

As explained above, the sound absorber of the second embodiment is formed so as to make sound absorption areas of the absorbing layers made of porous materials constant over the low to high frequency sound range.

Figure 3:
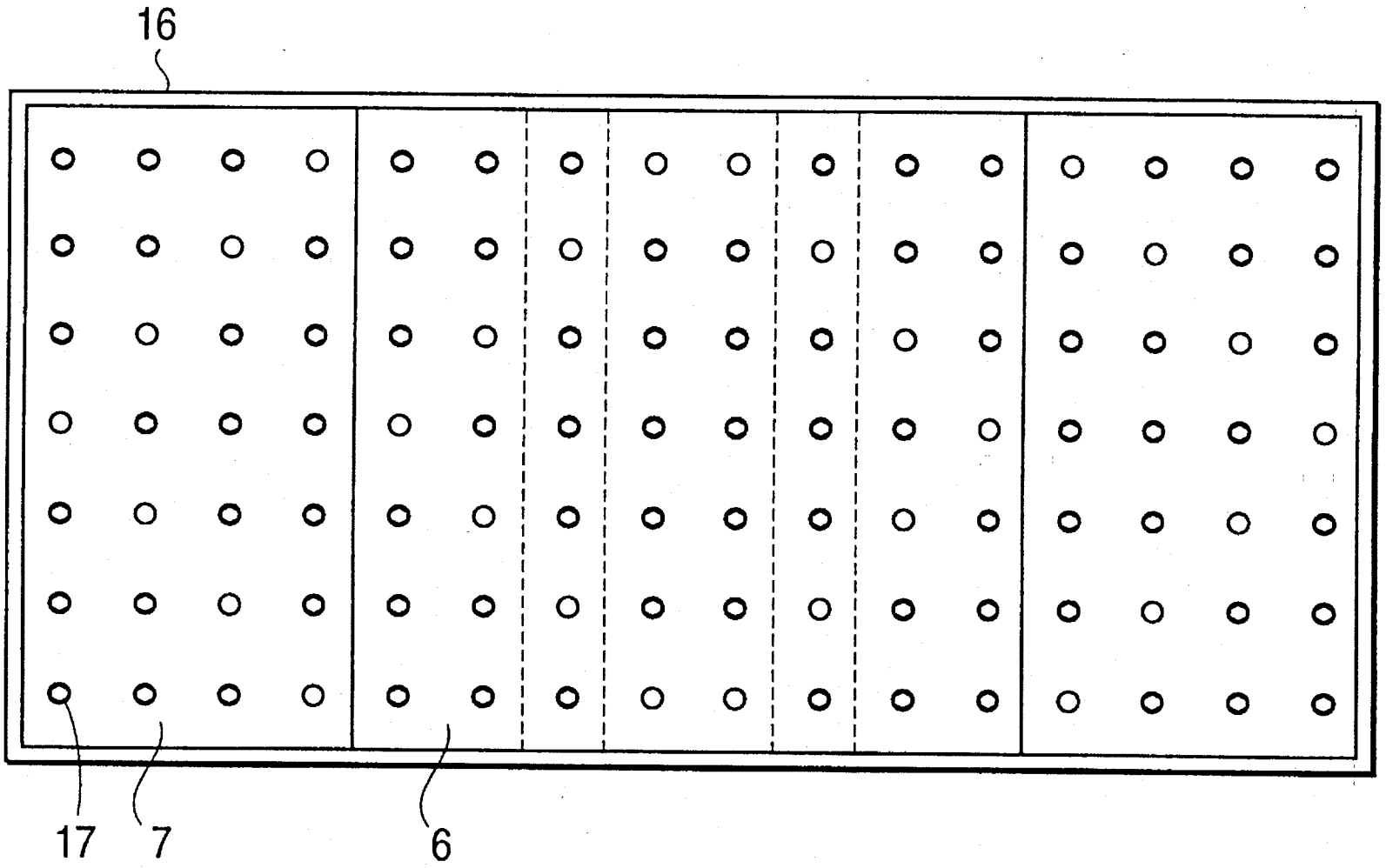
FIG. 3 is a front view of the sound absorber according to a third embodiment of this invention.
Figure 4:
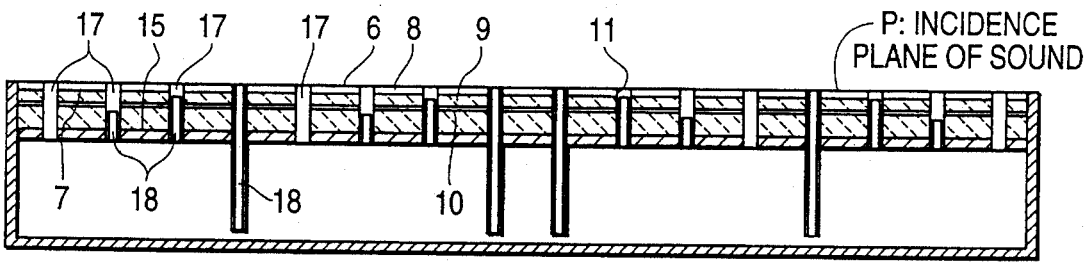
FIG. 4 is a cross-sectional view of the sound absorber shown in FIG. 3.

Next, a sound absorber according to a third embodiment of this invention will be described below while referring to the drawings. As shown in FIGS. 3 and 4, the sound absorber of the third embodiment uses a cabinet 16 having a substantially rectangular parallelepiped-shape, in which a front surface baffle 15 has an aspect ratio of 1:N, where N is a positive integer. On the cabinet 16, a plurality of sets of the absorbing layers 6, 9 and 11 made of porous materials which are formed of glass wool, rock fiber or cellular plastic, are different in thickness from each other and have their surfaces partially covered respectively with high-polymer films 7, 8 and 10 are laminated in parallel to the incidence plane P of sound. The absorbing layers 6, 9 and 11 made of porous materials are increased in thickness in the order from a side of the incidence plane P of sound, and their areas respectively covered with the high-polymer films 7, 8 and 10 are also increased in the same order as described above. Then, a plurality of perforated holes 17 passing from the incidence plane P of sound to the front surface baffle of the cabinet 16 are provided in the porous material sound absorption system (the sound absorber shown in the second embodiment) which is structured as shown above and has the constant sound absorbing coefficient over the low to high frequency sound range. The perforated holes 17 respectively have inserted pipes 18 whose outer diameters are substantially equal to diameters of the perforated holes 17 and whose lengths are different from the lengths of the perforated holes 17. Also, the sound absorber of the first embodiment may be used instead of the sound absorber of second embodiment. The operation of the sound absorber structured as above will be explained below. The porous material sound absorption system provided on a surface of the cabinet acts as a sound absorber whose sound absorbing coefficient is constant over the low to high frequency sound range. On the other hand, each of the inserted pipes 18 inserted into the perforated holes 17 acts as an acoustic mass. The cabinet 16 acts as an acoustic capacitance. As a result, the cabinet 16 and the inserted pipes 18 form a Helmholtz resonator. The Helmholtz resonator can absorb the sound over the low frequency sound range where the absorbing layers made of porous materials cannot absorb the sound. Since the inserted pipes 18 are different in length from each other, a plurality of Helmholtz resonance frequencies can be formed. Accordingly, by setting the Helmholtz resonance frequency of the Helmholtz resonator to the low frequency sound range so that the absorbing layers made of porous materials cannot absorb the sound, a wide frequency range sound absorber capable of performing sound absorption over the lower to high frequency sound range can be realized. Besides, since the aspect ratio (i.e. ratio of length-to-width) of the cabinet 16 is made so as to be N:1, where N is a positive integer, if plural cabinets are combined to form a surface of a wall, a size of the surface of the wall can be realized by integrally multiplying the length and the breadth thereof, respectively, thus making it possible to combine them without using partial sections. As a result, if forming one size of the length or the breadth with a reference size to be used for building a house, the surface of the wall can be formed without leaving any space by only joining cabinets in combination. For example, if a size of the surface of the wall of a room is specified in units of 1 m, 0.25 m can be the reference size. Also, if it is in units of 90 cm, 30 cm can be the reference size.

Figure 5:
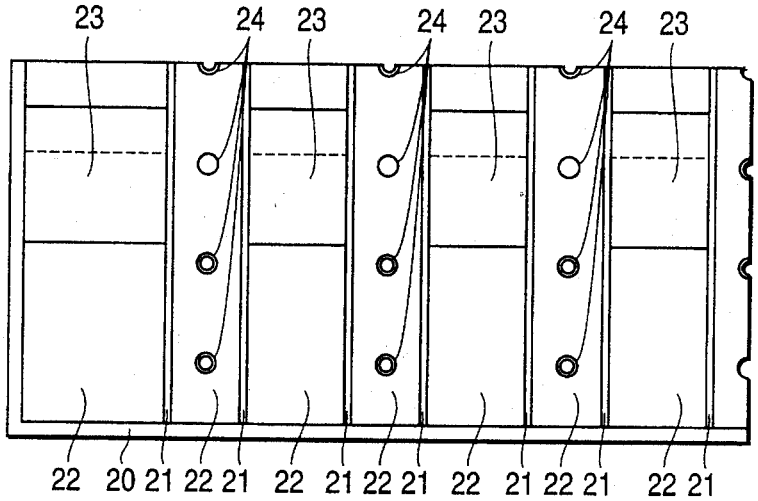
FIG. 5 is a front view of the sound absorber according to a fourth embodiment of this invention.
Figure 6:
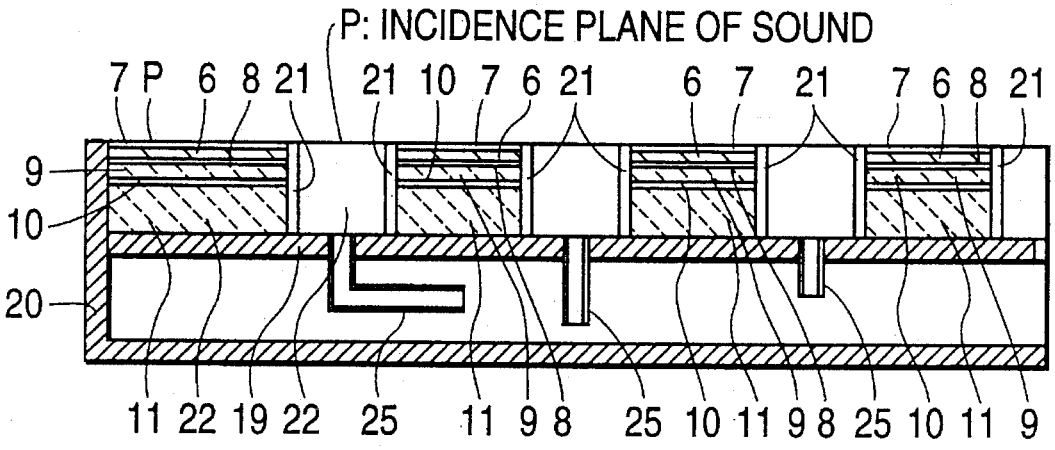
FIG. 6 is a cross-sectional view of the sound absorber shown in FIG. 5.

Next, a sound absorber according to a fourth embodiment of this invention will be described below while referring to the drawings. FIGS. 5 and 6 are front and cross-sectional views of the sound absorber of the fourth embodiment, respectively, each of which shows a quarter part thereof because of symmetrical construction. The sound absorber as shown in FIGS. 5 and 6 has a plurality of partitions 21 on a cabinet 20 which has a front surface baffle 19 with an aspect ratio (i.e. a ratio of width to length) of 1:N, where N is a positive integer, and is shaped substantially as a rectangular parallelepiped. In partitioned spaces 22, porous material sound absorption systems 23 and Helmholtz type sound absorption materials are alternately provided. The porous material sound absorption systems 23 are formed so that a plurality of sets of the absorbing layers 6, 9 and 11 made of porous materials which are formed of glass wool, rock fiber or cellular plastic, different in thickness from each other and partially covered respectively with the high-polymer films 7, 8 and 10 are laminated in parallel to the incidence plane P of sound. The absorbing layers 6, 9 and 11 made of porous materials are increased in thickness in order from the side of the incidence plane P of sound and their areas covered respectively with the high-polymer films 7, 8 and 10 are also increased in the same order as shown in FIG. 2. The sound absorber of the second embodiment of this invention or Helmholtz type sound absorption material has the front surface baffle 19 which has a plurality of perforated holes 24 into which the cylindrical pipes 25 having outer diameters substantially equal to diameters of the perforated holes 24 and lengths different from lengths of the perforated holes 24 are inserted. Also, the sound absorber of the first embodiment may be used instead of the sound absorber of the second embodiment.

Figure 7:
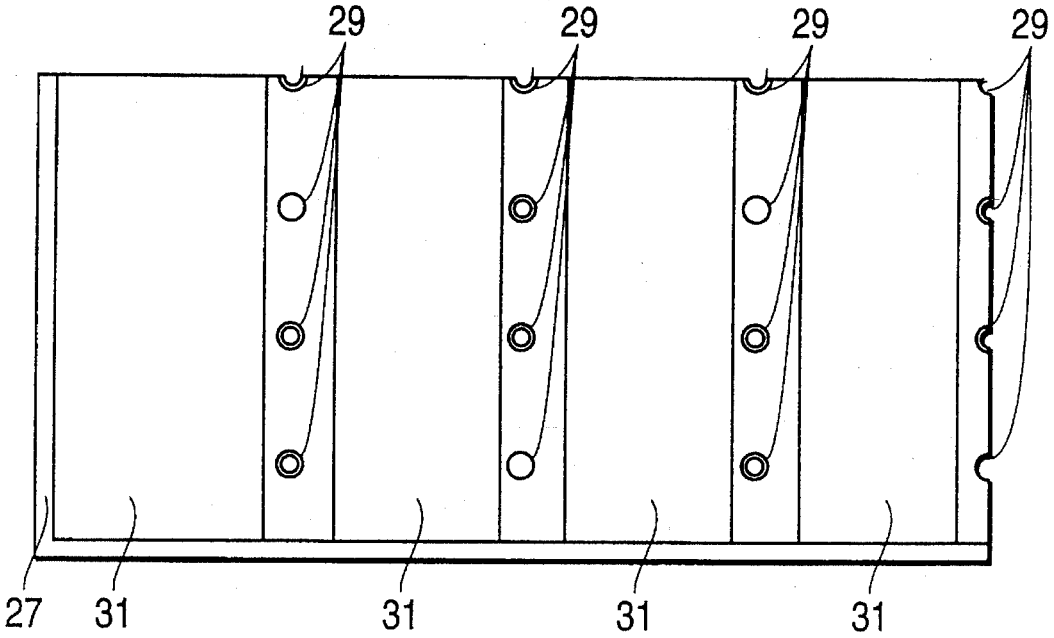
FIG. 7 is a front view of the sound absorber according to a fifth embodiment of this invention.
Figure 8:
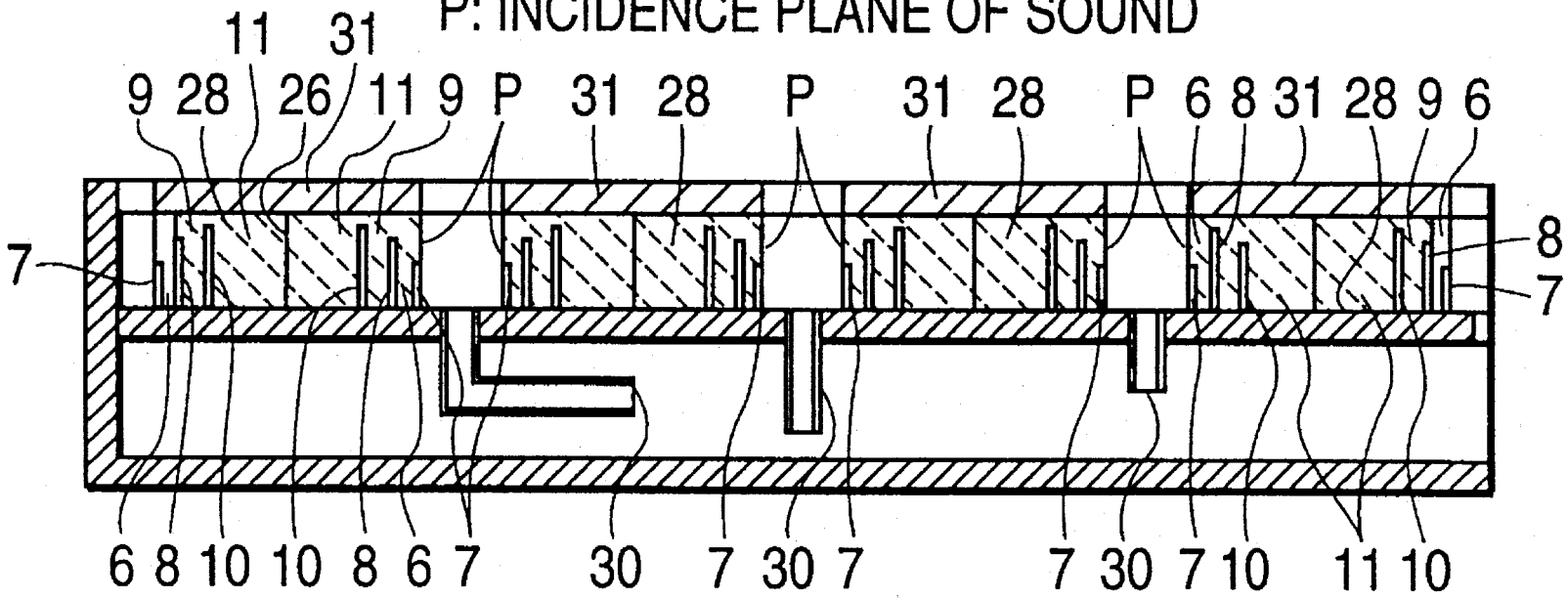
FIG. 8 is a cross-sectional view of the sound absorber shown in FIG. 7.
Figure 9:
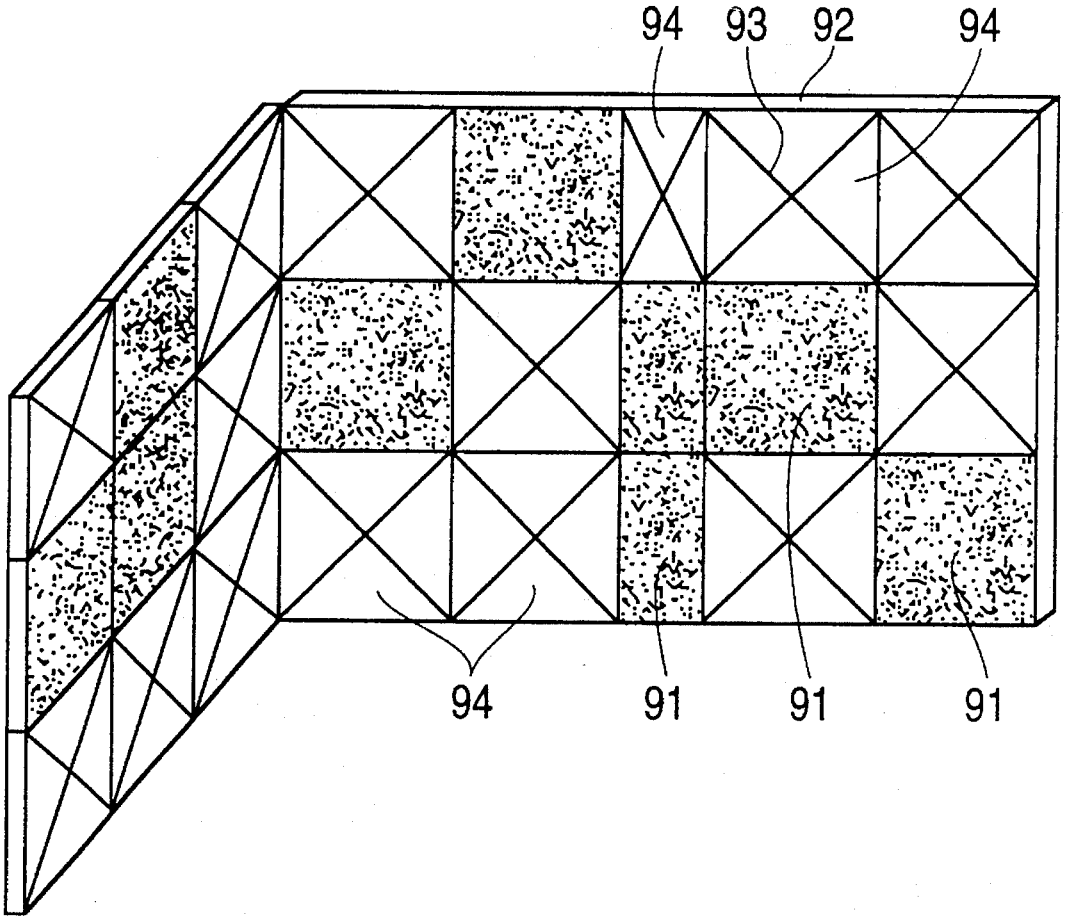
FIG. 9 PRIOR ART
FIG. 9 is a perspective view showing an example of a surface of a wall having conventional audio systems.
Figure 10:
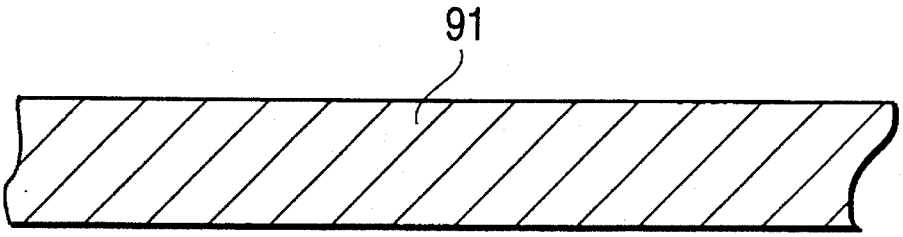
FIG. 10 PRIOR ART
FIG. 10 is a cross-sectional view of a porous material of sound absorber according to a conventional sound absorption method.

Next, a sound absorber according to a fifth embodiment of this invention will be described below while referring to the drawings. FIGS. 7 and 8 are front and cross-sectional views of the sound absorber of the fifth embodiment, respectively, each of which shows a quarter part thereof because of symmetrical construction. The sound absorber as shown in FIGS. 7 and 8 uses a cabinet 27 which is shaped substantially as a rectangular parallelepiped and has a front surface baffle 26 with an aspect ratio of 1:N, where N is a positive integer. On a surface of the front surface baffle 26 of the cabinet 27, porous material sound absorption systems 28, each having the constant sound absorbing coefficient over the low to high frequency sound range, and Helmholtz type sound absorption materials are alternately provided. Each of the porous material sound absorption systems 28 is formed so that a plurality of sets of the absorbing layers 6, 9 and 11 made of porous materials which are formed of glass wool, rock fiber and cellular plastic, different in thickness from each other and partially covered respectively with the high-polymer films 7, 8 and 10 are laminated in parallel to the incidence plane P of sound. The absorbing layers 6, 9 and 11 made of porous materials are increased in thickness in the order from the side of the incidence plane P of sound. In addition, areas of the absorbing layers 6, 9 and 11 made of porous materials partially covered respectively therewith are also increased in thickness in the order from the side of the incidence plane P of sound similar to the sound absorber shown in the second embodiment. Also, the sound absorber of the first embodiment may be used instead of the sound absorber of the second embodiment. Besides, the porous material sound absorption systems 28 have their surfaces opposite to the incidence plane P of sound abutted with each other so that the incidence plane P of sound of each of the porous material sound absorption systems 28 faces outside. The incidence plane P of sound of each of the porous material sound absorption systems is formed in parallel to a side surface of the cabinet. As a result, each of the porous material sound absorption systems 28 is adhered its one side surface vertically on the front surface baffle 26. To the other side surface thereof is adhered a reflection plate 31 in order to prevent the sound from being incident therefrom. On the other hand, in a case of the Helmholtz type sound absorption material, a plurality of perforated holes 29 provided in the front surface baffle 26 of the cabinet have inserted therein the cylindrical pipes 30 having outer diameters substantially equal to diameters of the perforated holes 29 and lengths different from lengths of the cylindrical pipes.

An operation of the sound absorber of the fourth embodiment and the sound absorber of the fifth embodiment shown above will be explained below. The porous material sound absorption systems 23 and 28 act as a sound absorber having a constant sound absorbing coefficient over the low to high frequency sound range. On the other hand, if the Helmholtz resonant frequency of the Helmholtz resonator consisting of the cylindrical pipes 25 and 30 inserted into the perforated holes 29 is set to such a lower frequency sound range that the absorbing layers made of porous materials cannot absorb, a sound absorber having a wider frequency sound range can be realized, Also, in the sound absorber of this invention, the sound frequency to be absorbed is different between the absorbing layers made of porous material and the Helmholtz sound absorption material. As a result, the Helmholtz sound absorption material does not absorb but rather reflects the sound over the frequency range that the absorbing layer made of porous material absorbs. On the other hand, the absorbing layer made of porous material does not absorb but reflects the sound over the frequency range that the Helmholtz sound absorption material absorbs. The porous material sound absorption systems 23, 28 and the Helmholtz sound absorption materials are provided alternately. That is, when the sound is incident to the sound absorber of this invention, there may exist a sound wave to be absorbed by the absorbing layers made of porous materials and a sound wave to be reflected through the perforated holes. Since such phenomena occur simultaneously on adjacent surfaces, phase interference will occur, which results in turbulence of a surface wavefront of the reflected sound wave and diffusion thereof. Such interference is largest with the sound having a frequency determined by an arrangement interval of absorbing layers made of porous materials. In a case of the surface of the wall having an absorption part and a reflection part of sound alternately, the sound wave having a wavelength equal to the arrangement interval of the absorbing layer made of porous materials will be diffused. Therefore, the sound wave is absorbed at a constant quantity and diffused due to the phase interference occurring on the surface of the wall. Thus the system is capable of obtaining a superior acoustic effect. Furthermore, irregularities formed in the absorbing layer made of porous materials and the Helmholtz sound absorption material act as a diffusing material. As a result, a sound reflection area of the room is increased and sound absorption and diffusion effect can be improved.

The claims are:

1. A sound absorber apparatus having a sound incidence surface extending generally along an incidence plane, said sound absorber apparatus comprising:

a rectangular parallelepiped-shaped cabinet having a front surface baffle;

a porous material sound absorption system fixed on said front surface baffle in parallel to the incidence plane;

a plurality of perforated holes provided in said porous material sound absorption system and passing from said sound incidence surface through said front surface baffle of said rectangular parallelepiped-shaped cabinet; and cylindrical pipes respectively disposed in said holes, said cylindrical pipe having outer diameters substantially equal to diameters of said perforated holes, respectively, and having lengths different from lengths of said perforated holes, respectively.

2. The sound absorber apparatus as claimed in claim 1, wherein said porous material sound absorption system comprises absorbing layers made of porous materials, and high-polymer films laminated in an alternating manner with said absorbing layers;

each of said absorbing layers and said high-polymer films extends in parallel to the incidence plane; and said absorbing layers have respective thicknesses which are successively greater in a direction moving away from the sound incidence surface.

3. The sound absorber apparatus as claimed in claim 1, wherein said porous material sound absorption system comprises absorbing layers made of porous materials, and high-polymer films laminated in an alternating manner with said absorbing layers;

each of said absorbing layers and said high-polymer films extends in parallel to the incidence plane;

said absorbing layers are different in thickness relative to one another, and have their respective surfaces partially covered with said high-polymer films, respectively;

said absorbing layers have respective thicknesses which are successively greater in a direction moving away from the sound incidence surface; and surface areas of said absorbing layers respectively covered with said high-polymer films are successively greater in a direction moving away from the sound incidence surface.

4. The sound absorber apparatus as claimed in claim 1, wherein said front surface baffle has a ratio of width to length of 1:N, where N is a positive integer.

5. The sound absorber apparatus as claimed in claim 2, wherein said front surface baffle has a ratio of width to length of 1:N, where N is a positive integer.

6. The sound absorber apparatus as claimed in claim 3, wherein said front surface baffle has a ratio of width to length of 1:N, where N is a positive integer.

* * * * *